United States Patent [19]

Lorenz et al.

[11] 4,008,840

[45] Feb. 22, 1977

[54] WORKPIECE TRANSPORTING APPARATUS

[75] Inventors: Horst Lorenz, Solingen; Kurt Pauls, Langenfeld, both of Germany

[73] Assignee: Th. Kieserling & Albrecht, Solingen, Germany

[22] Filed: Oct. 10, 1975

[21] Appl. No.: 621,632

[30] Foreign Application Priority Data

Oct. 18, 1974 Germany ..... 2449579

[52] U.S. Cl. ..... 226/173; 226/166

[51] Int. Cl.[2] ..... B65H 17/34

[58] Field of Search ..... 226/172, 173, 165, 166; 72/422

[56] References Cited

UNITED STATES PATENTS

| | | | |
|---|---|---|---|
| 1,911,157 | 5/1933 | Leech | 226/173 X |
| 2,213,336 | 9/1940 | Clouse | 72/422 |
| 2,228,748 | 1/1941 | Berkebil | 226/166 X |
| 3,103,306 | 9/1963 | Van Eldik | 226/172 |
| 3,351,034 | 11/1967 | Grek | 226/173 X |

*Primary Examiner*—Richard A. Schacher
*Attorney, Agent, or Firm*—Michael J. Striker

[57] ABSTRACT

The apparatus has a transporting arrangement which is movable in a predetermined direction and workpiece gripping devices which grip a workpiece to be withdrawn in this direction from a machine tool. The gripping devices are movable with the transporting arrangement in the aforementioned direction and are also movable relative to the transporting arrangement in and opposite to this direction. A control device controls the relative movement between the gripping device and the transporting device.

10 Claims, 5 Drawing Figures

WORKPIECE TRANSPORTING APPARATUS

BACKGROUND OF THE INVENTION

The present invention relates to a workpiece transporting apparatus in general, and more particularly to an apparatus for gripping an elongated workpiece and transporting it out of a machine tool.

Apparatus of this general type are already known in the art, for example from German Pat. No. 906,924 or from Gebrauchsmuster No. 734,164. They serve to withdraw elongated workpieces, for example rods, bars or the like, from drawing benches or turning lathes.

In order to obtain high and uniform withdrawing speeds as a workpiece is being withdrawn from a machine tool, such as a drawing bench or the like, it is necessary to utilize several gripping devices which grip the workpiece and withdraw it and which engage the workpiece in succession. However, during disengagement of one gripping device and engagement by the next one, special problems which heretofore have caused difficulties. Due to the change of the locus at which the gripping and withdrawing force acts upon the workpiece as one gripping device disengages the workpiece and another one engages it, the withdrawing speed, i.e., the speed at which the workpiece is withdrawn from the machine tool and is transported out of the same, is temporarily decreased. An additional negative effect results at the same time in that the workpiece tends to slip, approximately analogous to the release of a tensioned rubber cord, as the clamping jaws of one device disengage and before the clamping jaws of the next device have properly engaged the workpiece. This causes the clamping jaws to leave scraping marks on the workpiece which is undesirable. This problem occurs even if the releasing gripping device and the next-engaging gripping device are both driven by one and the same drive.

All of these problems are aggravated by the fact that demands are made for increased transporting and withdrawing speeds, and that these increased speeds require increased speeds of the gripping devices that must move to and fro in order to alternately engage and release the workpiece. This requires more and more complicated constructions that ultimately become too expensive to become economically feasible. From a certain withdrawing speed on, therefore, gripping devices which shuttle to and fro are no longer practical.

SUMMARY OF THE INVENTION

It is an object of the invention to overcome the disadvantages of the prior art.

More particularly, it is an object of the present invention to provide an improved apparatus for transporting elongated workpieces, such as rods, wires, bar, tubes or the like, which permits high transporting speeds that are as uniform as possible and which does not leave any scratch marks or similar marks on the workpiece.

Another object of the invention is to provide such an apparatus which is relatively simple in its construction and, therefore, comparatively inexpensive.

In keeping with these objects, and with others which will become apparent hereafter, one feature of the invention resides in an apparatus for gripping an elongated workpiece and drawing it out of a machine tool. Briefly stated, the apparatus comprises transporting means movable in a predetermined direction, workpiece gripping means for gripping the workpiece, this gripping means being movable with the transporting means and also being movable relative to the transporting means in and opposite to this direction, and control means for controlling the relative movement between the gripping means and transporting means.

This arrangement makes it possible to compensate for the stretching effect of workpiece and components of the apparatus itself, which result during transfer of the grip on the workpiece from one gripping device to another. The engagement of the workpiece by the gripping device, the disengagement, take place while the workpiece and the gripping device move substantially in synchronism so that no scratch marks develop on the workpiece. The engagement of the work piece by one device and the disengagement by the preceding device is effected without workpiece movements due to the stretching or contraction, and the workpiece is therefore not subject to sudden accelerations or the like and continues to travel at the substantially uniform withdrawing speed.

One feature of the invention provides for the transporting means to utilize at least one known pusher chain. A pulling chain, i.e., a chain subject to tension, would always have the disadvantage that the section located between the gripping device that is about to disengage from the workpiece and the gripping device that is about to engage the workpiece would be free of load, i.e., it would not be subjected to tensile stress. Because of this, the newly engaging gripping device briefly moves decidedly slower than the gripping device was moving which is disengaging the workpiece, and because at this critical phase of the transfer of engagement, the newly engaging gripping device performs no movement or hardly any, due to the stretching of the transporting means and the gripping device, a control of the movement of this newly engaging gripping device at this moment is not possible. On the other hand, a pusher chain, i.e., a chain which is subjected to longitudinal compression, is always under stress in the section between the newly engaging and the newly disengaging gripping devices and the movement of the newly engaging gripping device is not influenced by stretching of the chain intermediate the newly engaging and disengaging gripping devices.

It is currently preferred that the control means utilize an angular lever and a stretch compensating cam, the angular lever having one arm which extends in the transporting direction and another arm which extends transversely thereto. This is a particularly simple and economical solution and provides for control means that can be readily operated. Other solutions utilizing over-center levers or the like, are also possible and may not require a control cam, at least for part of the distance of travel of the transporting means.

The gripping devices may each utilize a roller-mounted wedge-shaped gripping jaw holder which holds gripping jaws, and at least one slidably mounted adjusting wedge. Such an arrangement assures that in the event of minimal relative movements between workpiece and gripping device prior to the engagement of the workpiece by the gripping device, such movements are relative movements of the jaws and the remainder of the gripping device, and not movements of the jaws and the workpiece. For this reason, the tension of the angle of the inclined rolling surface is accommodated to the coefficient of friction between workpiece and gripping jaws, thus providing a self-tightening arrangement. To cause the arrangement to grip the workpiece, the apparatus may further comprise engaging wedges each being connected with an arm of an engaging lever which is movably guided in the engaging wedges, the other arm of this lever being associated with a tensioning cam which extends approximately equidistant along the transporting chain which is the transporting means.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
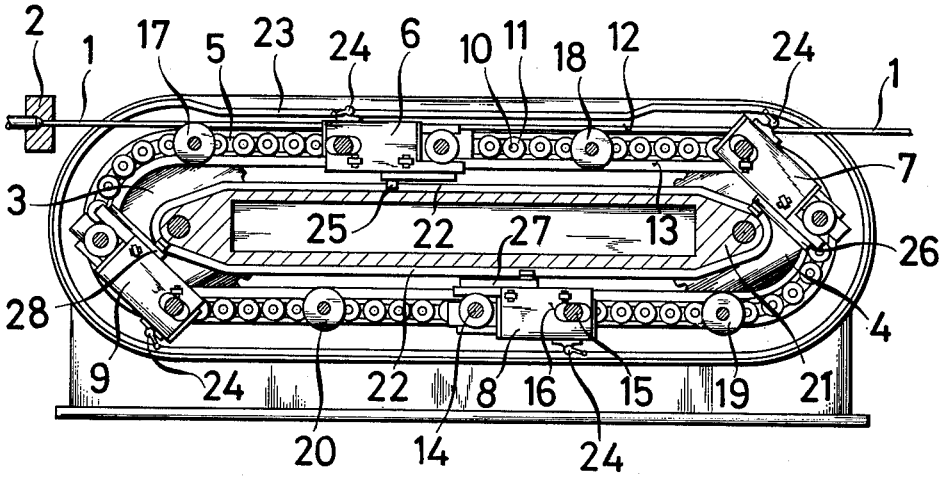
FIG. 1 is a somewhat diagrammatic side view showing the apparatus according to the present invention, together with an associated stretch compensating cam in conjunction with a drawing bench.
Figure 2:
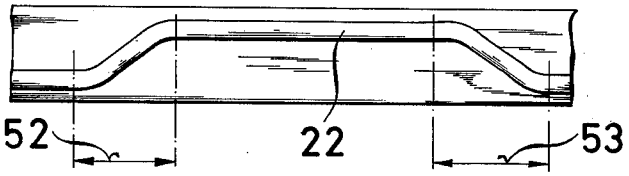
FIG. 2 is a top plan view of a gripping device of the apparatus in FIG. 1.
Figure 2:
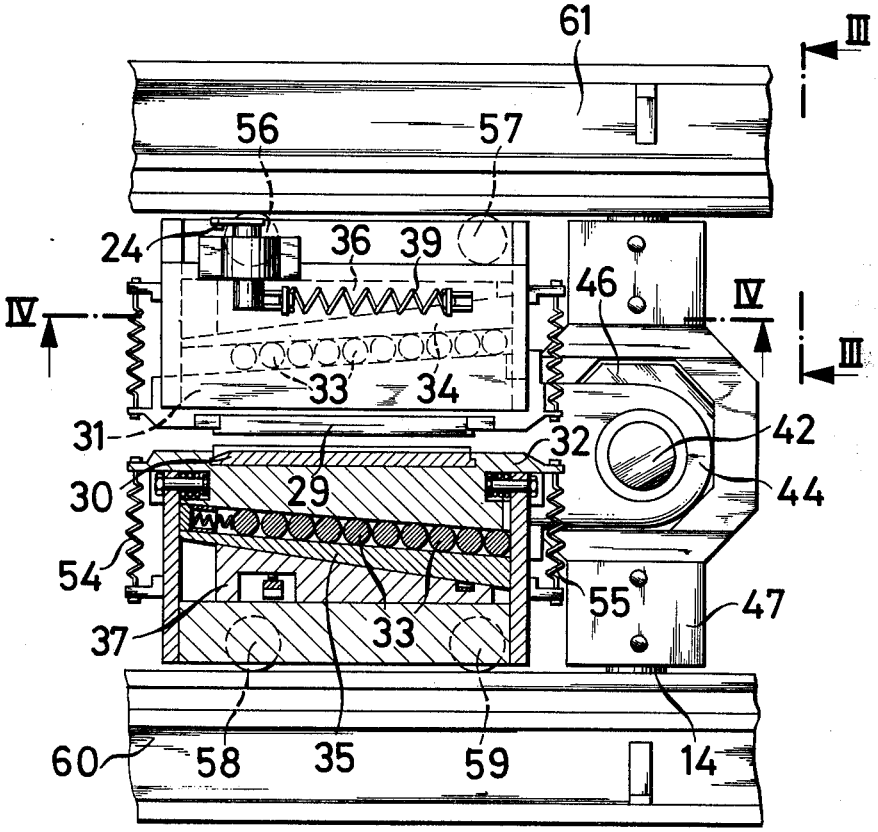
Figure 3:
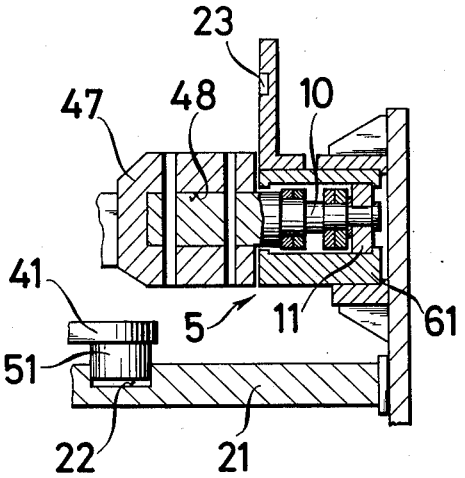
FIG. 3 is a view taken on line III—III of FIG. 2.

FIG. 1 illustrates an apparatus according to the present invention for gripping and withdrawing a workpiece, here in form of a wire 1, from a drawing nozzle 2 of a drawing bench. The apparatus has a pusher chain 5 which is trained about two chain wheels 3, 4. At uniform spacing, the chain 5 has mounted on it respective gripping devices 6, 7, 8 and 9. The chain 5, the wheels 3, 4 and the guide tracks for the chain are arranged in pairs in the machine.

Each chain bolt 10 of the chain 5 has mounted on it at least one guide roller 11. Guides 12, 13 serve to guide the chain 5 very precisely in the section intermediate the wheels 3 and the pulling gripping device 6 at the upper run of the chain, which section is subjected to pressure. Each of the devices 6, 7, 8 and 9 is pivoted to the chain 5 at two locations. One of the locations, identified with reference numeral 14, transmits the total tensile or pressure force upon the gripping device 6, 7, 8 or 9 in question, and the second pivotal connection 15 serves only to orient the respective gripping device and is composed, in the same manner as the pivotal connection 14, of an extended chain bolt which extends into an elongated slot 16. The slot 16 affords the bolt 15 sufficient room for compensating for all relative movements between the chain 5 and the respective gripping device 6–9.

Loose guide rollers 17, 18, 19 and 20 are arranged intermediate the respective gripping devices 6–9 and serve in particular to prevent the non-stressed portion of the wire 1 from being bent or flexed excessively.

In addition, the arrangement is provided with a stretch compensating cam 22 into which respective angular levers 25, 26, 27 and 28 of the respective gripping devices 6–9 engage. Also mounted on the machine are two tensioning cams 23 which are of identical configuration and arranged approximately equidistant relative to the chain 5. Each of the gripping devices 6–9 has two adjusting arms 24 which engage the cams 23.

The gripping devices 6–9 themselves each are composed of jaws 29, 30 which are mounted in jaw holders 31, 32 of wedge-shaped configuration. The wedge angles of the holders 31, 32 are selected with a view towards the coefficient of friction between the jaws and the workpiece 1 and the coefficient of rolling friction, in such a manner that a sliding of the engaged jaws relative to the workpiece 1 is prevented.

Figure 4:
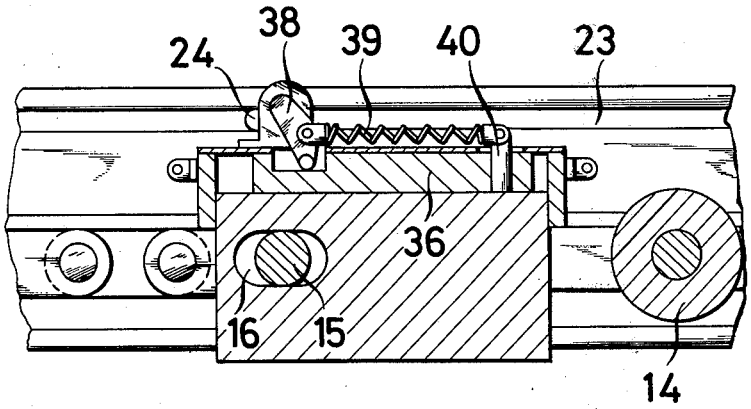
FIG. 4 is a view taken on line IV—IV of FIG. 2.
Figure 5:
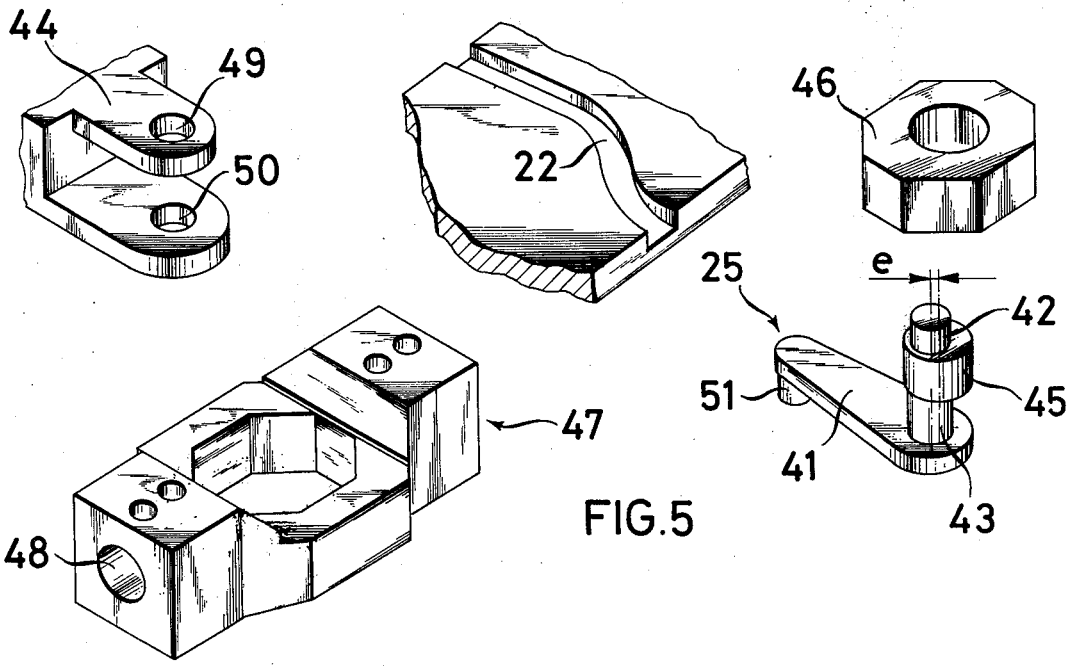
FIG. 5 is an exploded perspective view illustrating the control means and the manner in which the gripping device is mounted on the chain.

The jaw holders 31 and 32 are supported on rollers 33 and in direction transversely to the advancement of the wire 1 they are supported on intermediate wedges 34 and 35. Outwardly adjacent the wedges 34 and 35 there are provided slidably mounted adjusting wedges 36 and 37 which are each connected with an arm 38 of an adjusting lever 24, the arm 38 being movably guided in the respective wedges, as shown in FIG. 4. The wedge 36 is connected with the arm 38, for example via the bolt 40 and the spring 39. Changes in the guide track afforded by the cam 23 which extends approximately equidistant to the chains 5, cause the lever 24 to be pivoted.

Each of the gripping devices 6–9 is shiftable relative to the chain 5 in the direction of movement of the chain and opposite thereto. This relative movement is transmitted by the tension compensating cam 22 via the arm 41 of the lever 25, which arm 41 extends in the transporting direction of the wire 1, and via the bolt sections 42, 43 which are eccentric relative to the transporting direction by the measure *e*, to the member 44. The control device is composed of the lever 25, the slide member 46 and the member 47. The center portion 45 of the tripartite center region of the lever 25 is turnably journaled in the slide member 46 which is guided with a small amount of play in the member 47 for slide movement transverse to the direction of movement of the wire 1. Thus, the undesired components of movement which necessarily occur during the pivoting of the lever 25 are compensated. The member 47 is mounted on the chain 5 via the chain bolts 10 which extend into its lateral bores 48. The respective gripping device is mounted via the eccentric portions 42, 43 and the member 44 on the member 47, and hence on the chain 5.

The eccentric portions 42, 43 of the lever 25, which are bolt-like configurations, extend into the bores 49, 50 of the member 44. The roll-shaped extension 51 of the lever 25 extends into the tension compensating cam 22 on the machine body 21. In direction transversely to the transporting direction of the wire 1, the arrangement is supported by rollers 56, 57, 58 and 59 on the guide tracks 60 and 61.

The drawing and transporting operation of the apparatus in FIGS. 1–5 is as follows, starting with the position shown in FIG. 1.

The gripping device 6 draws the wire 1 out of the drawing nozzle 2; none of the other gripping devices are involved in drawing at this time. Toward the end of the drawing phase carried out by the gripping device 6, the gripping device 9 has moved to its operating position. At this time, the cam 23 and the levers 24 in the gripping device 9 first apply the jaw holders 31 and 32 with minimum force via the springs 39 and a spring associated with the wedge 37 but not illustrated, and via the wedges 36 and 37, against the workpiece 1. The entire chain 5 intermediate the wheel 3 and the gripping device 6 which at this time has advanced relative to the position shown for it in FIG. 1, is subjected to compression due to pushing. Now, a pivoting of the arms 28 and 25 causes the gripping devices 9 and 6 to be moved relative to the chain 5. The gripping device 9 is temporarily accelerated and the gripping device 6 is temporarily retarded. The jaws and the jaw holders do not shift relative to the wire 1 during these movements. During the relative displacement of the wedge-shaped jaw holders 31 and 32 relative to the intermediate wedges 34 and 35, the forces acting in the gripping device 9 increase and in the region 52 the gripping device 9 takes over the drawing of the wire 1 out of the drawing nozzle 2, whereas the drawing force exerted by the gripping device 6 decreases as the device 6 passes the region 53, due to its relative rearward movement. The cam regions 52 and 53 are so configurated that the sum of the drawing forces exerted by the just engaging and just disengaging gripping devices, i.e., here the devices 9 and 6, respectively, is approximately constant.

As the force with which the gripping device 6 engages the workpiece 1 and draws it diminishes, the jaw holders 31 and 32 move relative to the remainder of the gripping device 6 to a slight extent in the direction of advancement of the wire 1, but remain in engagement with the wire 1 without performing any movement relative to the same. To disengage the jaws from the wire 1, the lever 24 relaxes the spring 39 slightly. Thereafter, the arm 38 of the lever 24 moves the wedge 36 counter to the direction of advancement of the wire 1. The movement of the jaws in the direction radially of the wire 1 takes place only when the jaws are no longer pressed against the wire, so as to avoid scratching of the wire by the jaws. Each set of jaws is pressed together by springs 54 and 55 so that the jaws will effectively recede from the wire 1 when the wedges are withdrawn.

Due to the relative movements of the respective gripping devices 6–9 relative to the chain 5, the stretching of chain, gripping devices and wire 1 is compensated. The essential difference of the pushing chain 5 relative to a tension or pulling chain resides in the fact that the speed variation which results due to a relaxation of the chain between the devices 6 and 9 for the respective gripping devices is added to the transporting speed of the wire 1. Thus, none of the gripping devices 6–9 can have a speed equalling zero, and this assures that a control of the gripping devices 6–9 in dependence upon their movement can always be carried out without any difficulty.

It will be understood that each of the elements described above, or two or more together, may also find a useful application in other types of constructions differing from the type described above.

While the invention has been illustrated and described as embodied in an apparatus for transporting an elongated workpiece, it is not intended to be limited to the details shown since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic of specific aspects of this invention.

What is claimed as new and desired to be protected by Letters Patent is set forth in the appended claims.

1. Apparatus for gripping an elongated workpiece and drawing it out of a machine tool, comprising transporting means comprising a chain movable in a predetermined direction; workpiece gripping means for gripping the workpiece, said gripping means being movable with said transporting means and also being movable relative to said transporting means in and opposite to said direction, said gripping means comprising gripping devices each including gripping jaw, at least one wedge-shaped roller-adjustable jaw holder, and at least one slidably mounted adjusting wedge; control means for controlling the relative movement between said gripping means and transporting means; an adjusting lever having one arm and another arm which is movably guided in said adjusting wedges; spring means connecting said arm with said adjusting wedges; and tensioning cam means extending substantially equidistantly along said chain and cooperating with said one arm of said adjusting lever.

2. Apparatus for gripping an elongated work piece and drawing it out of a machine tool, comprising transporting means comprising a chain movable in a predetermined direction; workpiece gripping means for gripping the workpiece, said gripping means being movable with said transporting means and also being movable relative to said transporting means in and opposite to said direction, said gripping means comprising at least two gripping devices each held by a pair of chain bolts of said chain, one chain bolt of each pair being guided in a slot extending lengthwise of said direction; and control means for controlling the relative movement between said gripping means and transporting means.

3. An apparatus for gripping an elongated workpiece and drawing it out of a machine tool, said apparatus comprising: a transport chain displaceable in a predetermined direction; a plurality of grippers mounted on said chain at respective spaced-apart locations and each limitedly displaceable in said direction relative to said chain, each gripper having a pair of jaws displaceable toward and away from each other transverse to said direction; and control means effective between each of said grippers and said chain for closing the respective jaws on said workpiece and substantially immediately thereafter displacing the respective gripper forwardly in said direction on said chain and for displacing the respective gripper backwardly in said direction on said chain and substantially immediately thereafter opening said jaws to release said workpiece.

4. Apparatus as defined in claim 3, wherein said control means comprises an angled lever and a stretch-compensating cam, said lever having one section extending in said direction and another section extending transverse to said direction.

5. Apparatus as defined in claim 3, wherein said grippers each comprise at least one wedge-shaped roller-adjustable jaw holder, and at least one slidably mounted adjusting wedge.

6. Apparatus as defined in claim 5; further comprising an adjusting lever having one arm and another arm which is movably guided in said adjusting wedges, spring means connecting said arm with said adjusting wedges; and tensioning cam means extending substantially equidistantly along said chain and cooperating with said one arm of said adjusting lever.

7. Apparatus as defined in claim 3, and wherein said grippers each comprise at least two gripping devices each held by a pair of chain bolts of said chain, one chain bolt of each pair being guided in a slot extending lengthwise of said direction.

8. The apparatus defined in claim 3 wherein said control means includes separate first and second cams not displaceable in said direction, first operating means on each gripper operated by said first cam for closing and opening said jaws, and second operating means on each gripper operated by said second cam for displacing the respective gripper in said direction relative to said chain.

9. The apparatus defined in claim 8 wherein each of said operating means has mechanism and a respective cam follower arm extending transversely to said direction and engaging the respective cam.

10. The apparatus defined in claim 9 wherein said chain has a stretch extending in said direction, said cams extending along said stretch.

* * * * *